US009687906B2

(12) United States Patent
Lee et al.

(10) Patent No.: US 9,687,906 B2
(45) Date of Patent: Jun. 27, 2017

(54) SCROLL ROTOR MOLD, MOLDING DEVICE, AND METHOD FOR MANUFACTURING MOLD

(71) Applicant: KOREA INSTITUTE OF INDUSTRIAL TECHNOLOGY, Cheonan-si (KR)

(72) Inventors: Geun An Lee, Anyang-si (KR); Sang Mok Lee, Seoul (KR); Eung Zu Kim, Incheon (KR); Ki Ho Jung, Incheon (KR); Jong Sup Lee, Incheon (KR)

(73) Assignee: KOREA INSTITUTE OF INDUSTRIAL TECHNOLOGY, Cheonan-si (KR)

( * ) Notice: Subject to any disclaimer, the term of this patent is extended or adjusted under 35 U.S.C. 154(b) by 158 days.

(21) Appl. No.: 14/397,490

(22) PCT Filed: Mar. 6, 2013

(86) PCT No.: PCT/KR2013/001827
§ 371 (c)(1),
(2) Date: Oct. 28, 2014

(87) PCT Pub. No.: WO2013/165084
PCT Pub. Date: Nov. 7, 2013

(65) Prior Publication Data

US 2015/0121698 A1 May 7, 2015

(30) Foreign Application Priority Data

Apr. 30, 2012 (KR) ..... 10-2012-0045263

(51) Int. Cl.
*B21J 9/02* (2006.01)
*B21K 1/36* (2006.01)
(Continued)

(52) U.S. Cl.
CPC ..... *B21J 9/02* (2013.01); *B21C 23/211* (2013.01); *B21C 25/02* (2013.01); *B21J 13/02* (2013.01);
(Continued)

(58) Field of Classification Search
CPC .. B21J 9/02; B21J 13/02; B21C 25/02; B21C 23/211; B21K 3/00; B21K 1/36;
(Continued)

(56) References Cited

U.S. PATENT DOCUMENTS 4,720,899 A * 1/1988 Ando ..... B21J 1/06 29/888.022
6,702,907 B2 * 3/2004 Sato ..... B21C 23/14 148/551
2012/0192609 A1 * 8/2012 Horaguchi ..... B21J 3/00 72/41

FOREIGN PATENT DOCUMENTS

JP 06-172947 A 6/1994
JP 06-339740 A 12/1994
(Continued)

OTHER PUBLICATIONS

English Machine Translation of JPH07178494A (Jul. 18, 1995).*
(Continued)

*Primary Examiner* — Sarang Afzali
(74) *Attorney, Agent, or Firm* — Park, Kim & Suh, LLC

(57) ABSTRACT

A mold for forging a scroll rotor capable of controlling material flow speed by adjusting a land section, a molding device applying same, and a method for manufacturing the mold. In the mold, a die includes an extrusion unit having a molding space therein and a spiral-shaped extrusion passage provided in the lower portion thereof so as to correspond to a wrap portion disposed in the scroll rotor. A punch is connected to the die to be in close contact with the inner circumference of the molding space and to be able to slide
(Continued)

up and down. The lower portion has a shape corresponding to the upper surface of the flange portion of the scroll rotor and a boss portion. The extrusion passage has a land section in direct contact with the extrusion material. The height of a land of the land section varies along the spiral direction.

3 Claims, 5 Drawing Sheets

(51) Int. Cl.

| | |
|---|---|
| ***B21J 13/02*** | (2006.01) |
| ***B21C 23/21*** | (2006.01) |
| ***B21K 3/00*** | (2006.01) |
| ***B21C 25/02*** | (2006.01) |

(52) U.S. Cl.
CPC ..... *B21K 1/36* (2013.01); *B21K 3/00* (2013.01); *F04C 2230/00* (2013.01); *Y10T 29/4924* (2015.01)

(58) Field of Classification Search
CPC ..... Y10T 29/4924; F04C 18/0284; F04C 27/005; F04C 2240/801
See application file for complete search history.

(56) References Cited

FOREIGN PATENT DOCUMENTS

| | | | | |
|---|---|---|---|---|
| JP | 07-178494 | A | | 7/1995 |
| JP | 08-057572 | A | | 3/1996 |
| JP | 2006192450 | A | * | 7/2006 |

OTHER PUBLICATIONS

English Machine Translation of JPH06339740A (Dec. 13, 1994).*
English Machine Translation of JP2006192450A (Jul. 27, 2006).*
International Search Report in International Application No. PCT/KR2013/001827, dated Jun. 26, 2013.

* cited by examiner

SCROLL ROTOR MOLD, MOLDING DEVICE, AND METHOD FOR MANUFACTURING MOLD

CROSS-REFERENCE TO RELATED APPLICATIONS

This application is the National Stage filing under 35 U.S.C. 371 of International Application No. PCT/KR2013/001827, filed on Mar. 6, 2013, which claims the benefit of Korean Patent Application No. 10-2012-0045263, filed on Apr. 30, 2012, the contents of which are all hereby incorporated by reference herein in their entirety.

TECHNICAL FIELD

The present invention relates, in general, to a mold for a scroll rotor, a molding device, and a method of fabricating the same mold and, more particularly, to a mold for a scroll rotor able to control the speed of a flow of material by adjusting a land length and a taper, a molding device to which the same mold is applied, and a method of fabricating the same mold.

BACKGROUND ART

Generally, scroll rotors are applied to scroll compressors for vehicles or air conditioners. Scroll rotors have high cooling efficiency and little vibration noise, and can be used together with a substitute refrigerant. In addition, scroll rotors can reduce the volume of air conditioners due to the small size of compressors. Furthermore, a refrigerant gas leaks little and that either torque or load changes little. Due to these advantages, scroll rotors are widely used.

A wrap part of a scroll rotor is characterized in that it has a complicated and asymmetric shape since a spiral curve is formed around the central portion of the scroll. When a scroll rotor is fabricated using a typical forging process, the wrap part is not molded with even height. Post machining for reducing the unevenness of the height is thus required and a considerable amount of material is lost, thus reducing economic competitiveness, which is problematic.

As another approach for making the height of the wrap part to be even, closed-die forging was proposed. However, there are problems in that a molding load may rapidly increase at a final molding step, thereby damaging a mold and increasing danger to workers.

On the other hand, as a further approach for minimizing the unevenness of the height of the wrap part and reducing the amount of post machining, proposed was a method of molding a scroll rotor using back pressure. However, this method also has the following problems: (1) a separate hydraulic power supply for providing back pressure is required, and a molding load is increased by the back pressure; (2) bulging in the wrap part caused by the back pressure increases the contact pressure between the wrap part and the mold surface in an extrusion section, making it difficult to withdraw a molded product after molding is finished; and (3) additional maintenance for separate back pressure equipment is required.

DISCLOSURE

Technical Problem

Accordingly, the present invention has been made keeping in mind the above problems occurring in the prior art, and an object of the present invention is to provide a mold for a scroll rotor able to control the speed of a flow of material by adjusting a land length and a taper, a molding device to which the same mold is applied, and a method of fabricating the same mold.

Technical Solution

In order to accomplish the above object(s), the present invention provides a mold for forging a scroll rotor that includes: a die having a molding space defined therein and an extrusion outlet in the lower part, the extrusion outlet having a spiral extrusion passage conforming to a wrap part of a scroll rotor; and a punch connected to the die, the punch being slidable in the upward and downward direction in close contact with the inner circumference of the molding space, the lower part of the die having a shape conforming to the top surface of a flange and a boss of the scroll rotor. The extrusion passage includes a land section that is to be in direct contact with an extruded material, the length of the land section varying along the spiral direction.

It is preferred that the length of the land section exhibits a secondary continuous decrease along the spiral direction from a maximum value at the central portion, before increasing again.

It is preferred that the land section has a taper, the width of which decreases along the direction in which the extruded material flows when the material is being extruded.

Also provided is a molding device for molding a scroll rotor in which the above-described mold for a scroll rotor is disposed.

Also provided is a method of fabricating a scroll rotor including the following steps of: placing the above-described mold for a scroll rotor in a molding device; seating a material within the molding space of the mold; molding a scroll rotor by deforming the material by applying a pressure to the material with a punch; and withdrawing the molded scroll rotor from the die.

Advantageous Effects

According to the present invention, the following effects can be obtained.

Specifically, it is possible to minimize the unevenness of the height of the wrap part by controlling the speed of a flow of material by adjusting the land length and the taper in the extrusion section of the mold. Consequently, it is possible to reduce the amount of post machining required to make the height of the wrap part of the scroll rotor to be even, as well as to reduce the amount of the material that is wasted, thereby improving efficiency and economic competitiveness.

In addition, the taper formed on the extrusion outlet of the mold makes it easier to withdraw a molded scroll rotor, thereby improving the convenience of operation.

In particular, since additional back pressure equipment is not required, the molding process for a scroll rotor is simplified and no maintenance for back pressure equipment is required, which is economically advantageous.

Figure 1:
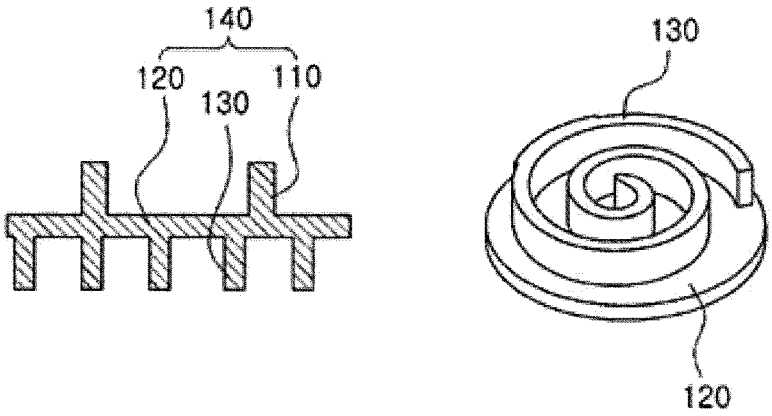
FIG. 1 shows a cross-sectional view and a perspective view of a scroll rotor.

<Description of the Reference Numerals in the Drawings>

| | |
|---|---|
| 110: boss part | 120: flange |
| 130: wrap part | 140: scroll rotor |
| 210: punch | 220: die |
| 230: molding space | 240: mold |
| 300: extrusion outlet | 310: taper |
| 320: land | 330: land section |
| 400: molding device | S100: mold placing step |
| S200: material seating step | S300: pressure molding step |
| S400: product withdrawal step | |

BEST MODE

Reference should now be made to the features and exemplary embodiments of the present invention in conjunction with the drawings.

FIG. 1 shows a cross-sectional view and a perspective view of a scroll rotor.

Referring to FIG. 1, a scroll rotor 140 includes a disk-shaped flange 120, a boss 110 on the top surface and a wrap part 130 on the bottom surface. The wrap part 130 has a spiral asymmetric pattern in the shape of a scroll that spirally extends from the central portion. In the following, the same reference numerals will be used to refer to the same or like parts, and repeated descriptions of the same or like parts will be omitted.

Figure 2:
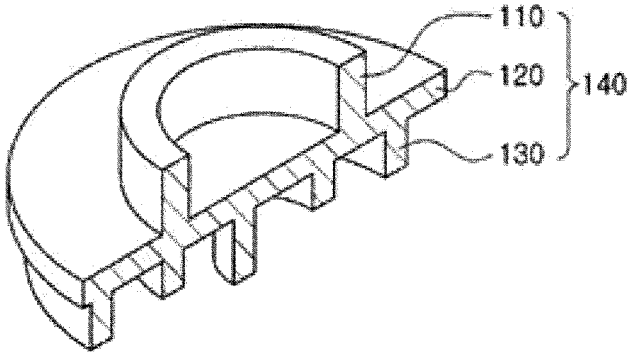
FIG. 2 is a cutaway perspective view of a scroll rotor fabricated by a typical forging process.

FIG. 2 is a cutaway perspective view of a scroll rotor fabricated by a typical forging process.

Referring to FIG. 2, the wrap part 130 has a complicated asymmetrical shape, which causes the speed and amount of a flow of material extruded through an extrusion outlet along a spiral direction from the central portion to change during the extruding process, whereby the height of the wrap part 130 becomes uneven. Therefore, a post machining operation of cutting a molded product is undertaken in order to make the height of the wrap part 130 to be even, and a considerable amount of material is wasted, making this process significantly uneconomical.

Figure 3:
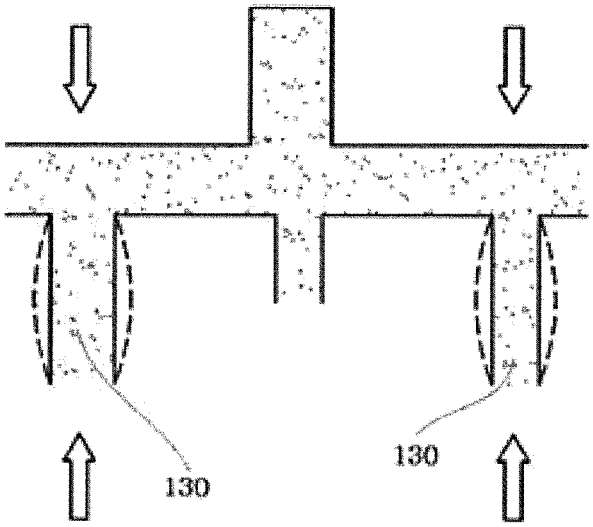
FIG. 3 illustrates bulging in a material due to back pressure.

FIG. 3 illustrates bulging in a material due to back pressure.

Referring to FIG. 3, a material flows through an extrusion outlet within a molding space when pressed with a punch. Bulging occurs in the wrap part while back pressure is acting in the upward direction to adjust the height of the wrap part. This consequently increases the contact pressure between the material and the mold surface in an extrusion zone, thereby making it difficult to withdraw a molded product.

Figure 4:
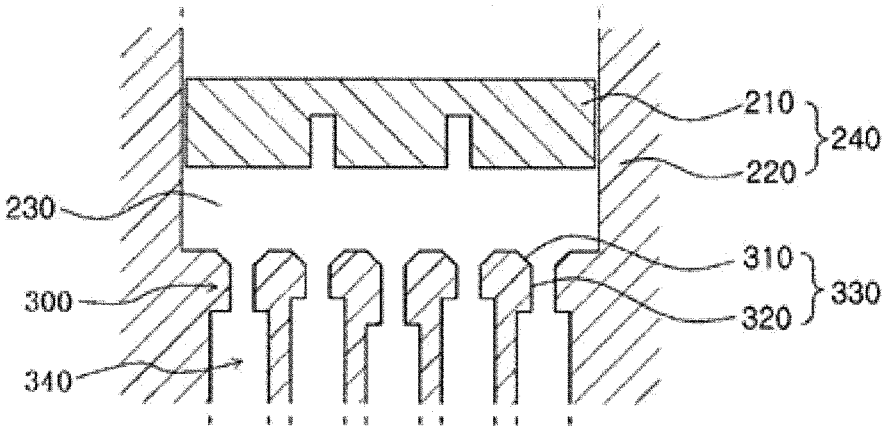
FIG. 4 is a cross-sectional view illustrating an exemplary embodiment of a mold according to the present invention.
Figure 5:
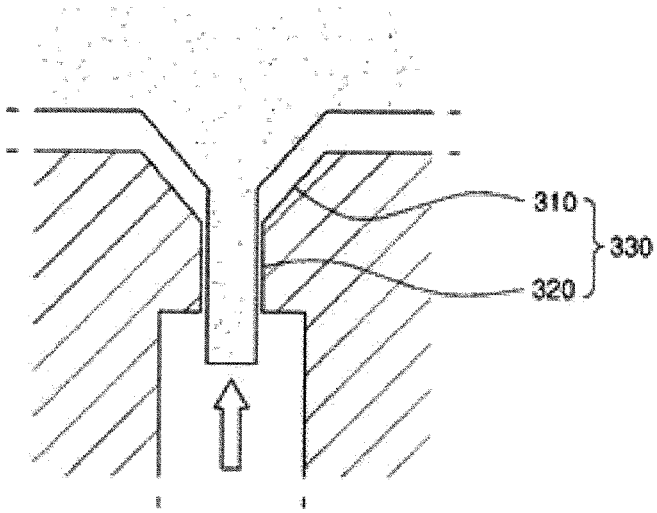
FIG. 5 is an enlarged cross-sectional view illustrating an extrusion outlet having a land section to which a taper is applied.

FIG. 4 is a cross-sectional view illustrating an exemplary embodiment of a mold according to the present invention, and FIG. 5 is an enlarged cross-sectional view illustrating an extrusion outlet having a land zone to which a taper is applied.

Referring to FIG. 4 and FIG. 5, the mold according to an embodiment of the present invention includes a die 220 and a punch 210.

The die 220 has defined therein a cylindrical molding space 230. An extrusion outlet 300 for molding the wrap part 130 through extrusion is disposed on the bottom of the molding space 230. The extrusion outlet 300 is provided with an extrusion passage 340 conforming to the shape of the wrap part 130 of the scroll rotor. The extrusion passage 340 is directly connected to the molding space 230, and has a land section 330, the inner surface of which comes into direct contact with a material when the material is being extruded. The land section 330 includes a taper 310 positioned upstream in the direction in which the extruded material flows and a land 320 positioned downstream. The taper 310 is configured such that the width decreases in the direction in which the extruded material flows when the material is being extruded. It is therefore possible to increase frictional resistance by increasing the contact pressure between the flowing material and the contact surface of the mold. In addition, when the taper 310 is applied to the extrusion outlet 300, the extruded portion is molded in the shape of a wedge, making it easier to withdraw a molded scroll rotor from the die 220.

The punch 210 is connected to the die 220 such that it can slide in the upward and downward direction in close contact with the inner circumference of the molding space 230. The shape of the lower part of the punch 210 conforms to the top surface of the flange 120 and to the boss 110.

In response to being pressed with the punch, the material within the molding space 230 flows through the extrusion passage 340. The speed of the flow of the material continuously changes along the spiral direction from the central portion. The speed of the flow of the material is controlled by adjusting the length of the land section 330. According to the present invention, the length of the land section 330 indicates the length of the extruded material extending in the flow direction thereof when the material is being extruded.

In general, the extrusion mold has a land section in order to obtain the ability of the material to flow straight In this mold, a longer land section increases the contact area, increasing friction. Therefore, it is possible to control the speed of the flow of the material using the friction between the material and the mold surface by suitably adjusting the length of the land section to have a preset distribution along the spiral direction from the central portion.

Figure 6:
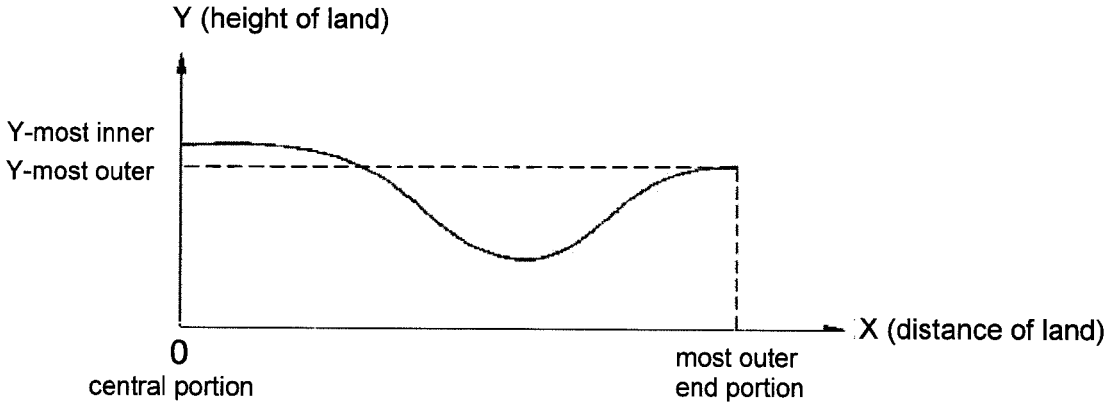
FIG. 6 is a graph illustrating the distribution of the length of a land along the spiral direction from the central portion of a die.

A finite element method (FEM) program is used in order to set a suitable height distribution for a land. FIG. 6 is a graph illustrating the distribution of the height of land shown in FIG. 5 along the spiral direction from the central portion.

Referring to FIG. 6, X axis indicates the distance of the land along the spiral direction from the central portion, and Y axis indicates the height of the land 320. The curve shown in FIG. 6 shows a secondary continuous decrease of the height of the land 320 along the spiral curve from the maximum value at the central portion, before increasing again. In other words, the height of the land 320 has the maximum value when X=0, and it reaches its minimum value at a predetermined distance of X. The height of the most inner portion of the land 320 is greater than the height of the most outer end portion of the land 320. However, the present invention is not limited thereto and similar variations in the height of the land are embraced within the scope of the present invention.

Figure 7:
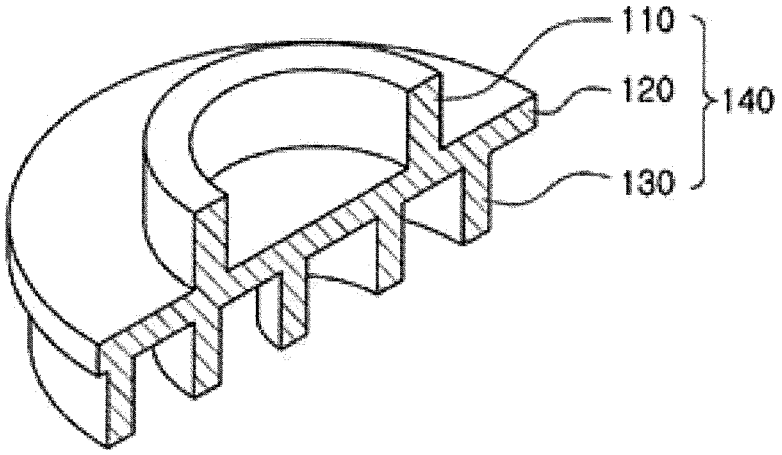
FIG. 7 is a cutaway perspective view illustrating an exemplary embodiment of a scroll rotor molded using a mold according to the present invention.

FIG. 7 is a cutaway perspective view illustrating an exemplary embodiment of a scroll rotor molded using a mold according to the present invention. Referring to FIG. 7, it is possible to mold the scroll rotor 140, with the unevenness of the height of the wrap part 130 being minimized, using the mold 240 according to an exemplary embodiment of the present invention.

Figure 8:
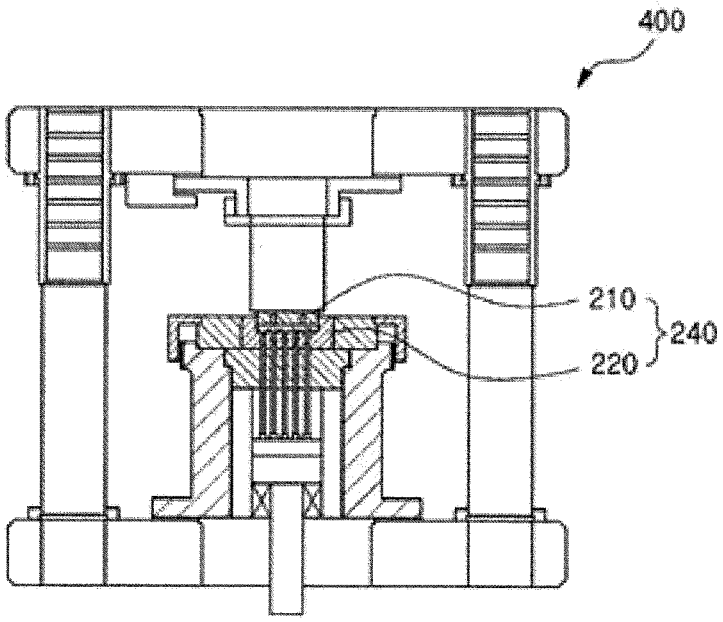
FIG. 8 illustrates an exemplary embodiment of a molding device provided with a mold according to the present invention.

FIG. 8 illustrates an exemplary embodiment of a molding device equipped with the mold according to the present invention. Referring to FIG. 8, the molding device 400 equipped with the mold 240 is provided according to an exemplary embodiment of the present invention.

Figure 9:
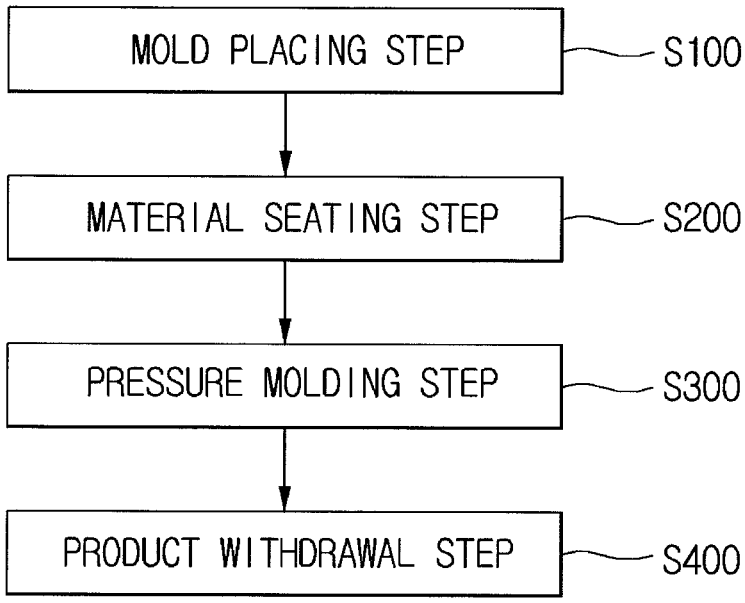
FIG. 9 is a process flowchart illustrating an exemplary embodiment of a method of fabricating a scroll rotor using a mold according to the present invention.

FIG. 9 is a process flowchart illustrating an exemplary embodiment of a method of fabricating a scroll rotor using a mold according to the present invention. Referring to FIG. 9, the method of fabricating a scroll rotor according to an exemplary embodiment of the present invention includes a mold placing step S100, a material seating step S200, a pressure molding step S300 and a product withdrawal step S400.

The mold placing step S100 includes placing the mold 240 within an existing molding device. The material seating step S200 includes seating a material that has been primarily machined within the molding space 230 of the mold 240 for forging. The pressure molding step S300 includes molding the scroll rotor 140 by deforming the material by applying a pressure to the material with the punch 210. The product withdrawal step S400 includes withdrawing the molded scroll rotor 140 from the die 220.

Although the exemplary embodiments of the present invention have been described for illustrative purposes, those skilled in the art will appreciate that various modifications, additions and substitutions are possible, without departing from the scope and spirit of the present invention as disclosed in the accompanying claims.

The invention claimed is:

1. A mold for forging a scroll rotor comprising:

a die comprising a molding space defined therein and an extrusion outlet in a lower part, the extrusion outlet having a spiral extrusion passage conforming to a wrap part of a scroll rotor; and a punch connected to the die, the punch being slidable in an upward and downward direction in close contact with an inner circumference of the molding space, a lower part of the die having a shape conforming to a top surface of a flange and a boss of the scroll rotor, wherein the spiral extrusion passage comprises a land section that is in direct contact with an extruded material when the material is being extruded, wherein the land section comprises a taper and a land, first and second vertical heights of most inner and outer end portions of the land are greater than a third vertical height of a middle portion of the land, respectively, and the first height is greater than the second height, and wherein a width of the taper decreases along a direction in which the extruded material flows when the material is being extruded.

2. A molding device for molding a scroll rotor in which the mold for forging the scroll rotor as claimed in claim 1 is disposed.

3. A method of fabricating a scroll rotor comprising:

placing the mold for forging the scroll rotor as claimed in claim 1 in a molding device;

seating a material within the molding space of the die of the forging mold;

molding a scroll rotor by deforming the material by applying a pressure to the material with the punch connected to the die; and withdrawing the molded scroll rotor from the die.

* * * * *